US006981500B2

(12) United States Patent
Li et al.

(10) Patent No.: US 6,981,500 B2
(45) Date of Patent: Jan. 3, 2006

(54) RESPIRATORY TUBE WITHOUT FASTENING ASSEMBLIES

(76) Inventors: Yun-Chian Li, No. 176-1, Shang-Fang-Liao, Lin 6, Shang-Liao Li, Hsin-Pu Chen, Hsin-Chu Hsien (TW); Kuang-Jeng Lee, No. 176-1, Shang-Fang-Liao, Lin 6, Shang-Liao Li, Hsin-Pu Chen, Hsin-Chu Hsien (TW); Kuang-Yin Lee, No. 176-1, Shang-Fang-Liao, Lin 6, Shang-Liao Li, Hsin-Pu Chen, Hsin-Chu Hsien (TW); Jen-Yin Liu, No. 176-1, Shang-Fang-Liao, Lin 6, Shang-Liao Li, Hsin-Pu Chen, Hsin-Chu Hsien (TW)

( * ) Notice: Subject to any disclaimer, the term of this patent is extended or adjusted under 35 U.S.C. 154(b) by 216 days.

(21) Appl. No.: 10/691,491

(22) Filed: Oct. 24, 2003

(65) Prior Publication Data

US 2005/0087192 A1 Apr. 28, 2005

(51) Int. Cl.
*B23C 11/16* (2006.01)
*A62B 18/08* (2006.01)

(52) U.S. Cl. ..... 128/201.11; 128/200.29; 128/201.28; 128/207.11; D24/110.5

(58) Field of Classification Search ..... 128/201.11, 128/201.28, 207.11, 200.29, 206.29, 207.18; D24/110.5; 441/124; 482/55; D21/801, D21/803, 804
See application file for complete search history.

(56) References Cited

U.S. PATENT DOCUMENTS

| | | | | | |
|---|---|---|---|---|---|
| 1,081,745 | A * | 12/1913 | Johnston et al. | ..... | 128/203.25 |
| 1,282,527 | A * | 10/1918 | Bidonde | ..... | 128/201.11 |
| 1,539,733 | A * | 5/1925 | Haskell | ..... | 128/201.11 |
| 2,818,067 | A * | 12/1957 | Rebikoff et al. | ..... | 128/201.11 |
| D350,379 | S * | 9/1994 | Kirchner | ..... | D24/110.5 |
| 6,073,626 | A * | 6/2000 | Riffe | ..... | 128/201.11 |
| 6,318,363 | B1 * | 11/2001 | Monnich | ..... | 128/201.11 |
| 6,516,802 | B2 * | 2/2003 | Hansen et al. | ..... | 128/207.11 |
| 6,854,465 | B2 * | 2/2005 | Bordewick et al. | .... | 128/207.11 |

* cited by examiner

*Primary Examiner*—Henry Bennett
*Assistant Examiner*—Dinnatia Doster-Greene
(74) *Attorney, Agent, or Firm*—Troxell Law Office, PLLC

(57) ABSTRACT

A front-worn respiratory tube without fastening assemblies namely fastening rings, hooks, buttons, clamps, sheaths or strips, includes a head-top-portion tube, a forehead-portion tube, a mouth-eyebrow-portion tube, a mouthpiece and a fish-mouth-shaped mouthpiece in a downward direction in sequence. Wherein, the aforesaid five parts are either wedge-type structures or join-type structures at three parts (from the head-top-portion tube to the forehead-portion tube, from the forehead-portion tube to the mouth-eyebrow-portion tube, and from the mouth-eyebrow-portion tube to the mouthpiece portion). The forehead-portion tube utilizes water drag force to have the tube steadily staying close to the user's head. A water-drop-shaped sectional area at the head-top-portion tube is capable of minimizing water drag. The aforesaid structure according to the invention is adaptable to head dimensions and a height of a nose tip of the user.

6 Claims, 10 Drawing Sheets

RESPIRATORY TUBE WITHOUT FASTENING ASSEMBLIES

BACKGROUND OF THE INVENTION (a) Field of the Invention

The invention relates to a respiratory tube without fastening assemblies, and more particularly, to a respiratory tube without fastening assemblies namely fastening rings, hooks, buttons, clamps, sheaths and strips. Using various structural designs of the respiratory tube, the respiratory tube without fastening assemblies is steadily stayed close to a front side of a user's head when being worn.

(b) Description of the Prior Art

Respiratory tubes for water activities such as swimming and diving come in various shapes and sizes, and are generally divided into two categories:

1. Side-worn respiratory tubes located at one side of swimmers when being worn: these respiratory tubes are the majority and most commonly seen.
2. Front-worn respiratory tubes located at a front side of swimmers when being worn: these respiratory tubes are the minority and are hardly seen.

Regarding the former respiratory tube, when the respiratory tube is worn at a side of the swimmer, apart from a water drag sectional area already present from an original volume (a body of the swimmer), an extra water drag sectional area adds up to an even larger value due to a substantial length of the respiratory tube exceeding the user's shoulder level. Consequently, water drag force is enlarged with greater strength consumed. In addition, drag force is unbalanced for that the respiratory tube is located only at one side, and movements of a swimmer at the particular side may become restricted. In the long-run, a swimmer is likely resulted with slanted strokes and thus limited advancement.

As for the latter respiratory tube, when the respiratory tube is worn at a front side of a swimmer, apart from a water drag sectional area already present from an original volume (a body of the swimmer), only a small water drag sectional area is added by a small sectional area of the respiratory tube exceeding the user's head level. Therefore, water drag force is increased with a least amount while also consuming minimum strength. In addition, because the respiratory tube is worn at a front side of the user, drag force at two sides are balance without causing issues such as restricting movements of the swimmer.

However, to maintain the respiratory tubes at appropriate positions of a swimmer's head, both of the aforesaid prior inventions require externally provided assemblies namely fastening rings, hooks, buttons, clamps, sheaths or strips, which are not parts of the respiratory tubes. These assemblies have also brought some common drawbacks:

1) water drag is increased to diminish more strength; and
2) when a swimmer's actions relative to water get faster (for example, diving at start-up or turning around), water drag is further expanded to cause disengagement or displacement of the respiratory tube, and it is necessary that the user immediately adjust the respiratory tube for continual use.

Both the aforesaid drawbacks are unfavorable for developing skills and technique refinement of swimmers.

SUMMARY OF THE INVENTION

An object of the invention is to provide a respiratory tube without fastening assemblies namely fastening rings, hooks, buttons, clamps, sheaths or strips and for overcoming the aforesaid drawbacks. According to the invention, the respiratory tube comprises three crucial parts including a head-top-portion tube, a forehead-portion tube and a mouth-eyebrow-portion tube. The invention functions in conjunction with a mouthpiece and a fish-mouth-shaped mouthpiece joined with the three aforesaid tubes. In addition, a lower end of the mouthpiece is sealed or installed with a one-direction valve for discharging water and air in a downward direction.

DETAILED DESCRIPTION OF THE PREFERRED EMBODIMENTS

Figure 1:
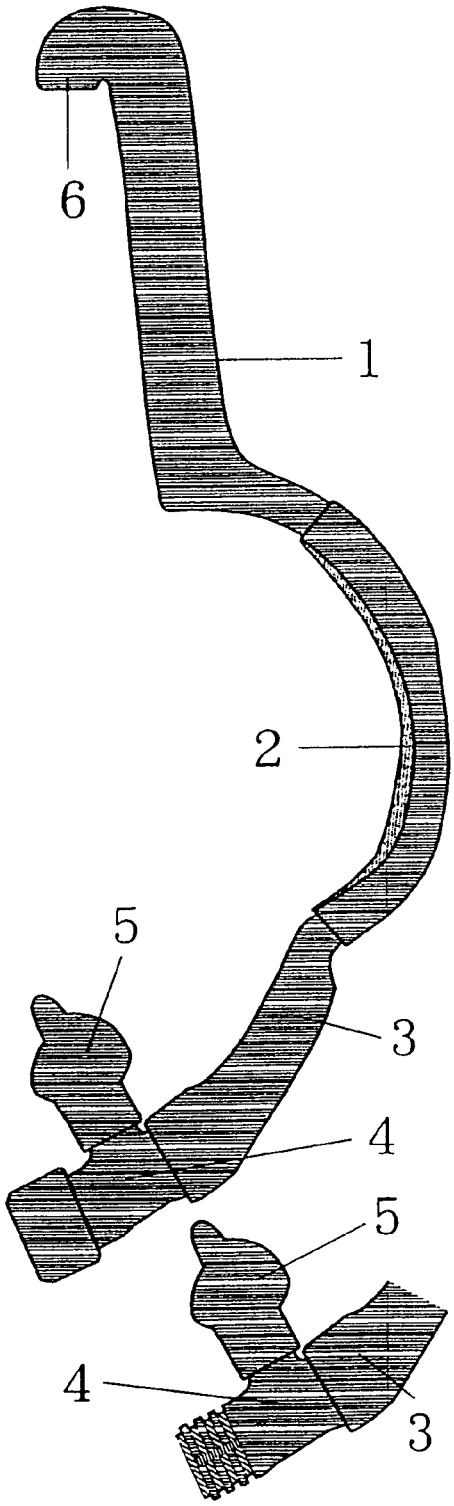
FIG. 1 shows a left side elevational schematic view illustrating a wedge-type structure according to the invention.
Figure 2:
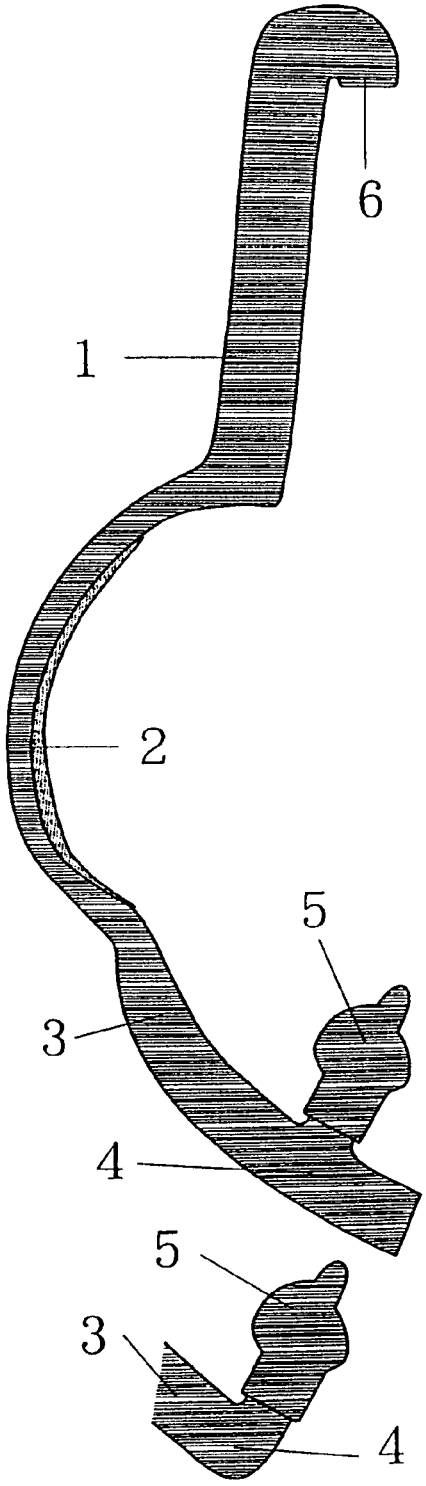
FIG. 2 shows a right side elevational schematic view illustrating a join-type structure according to the invention.
Figure 3:
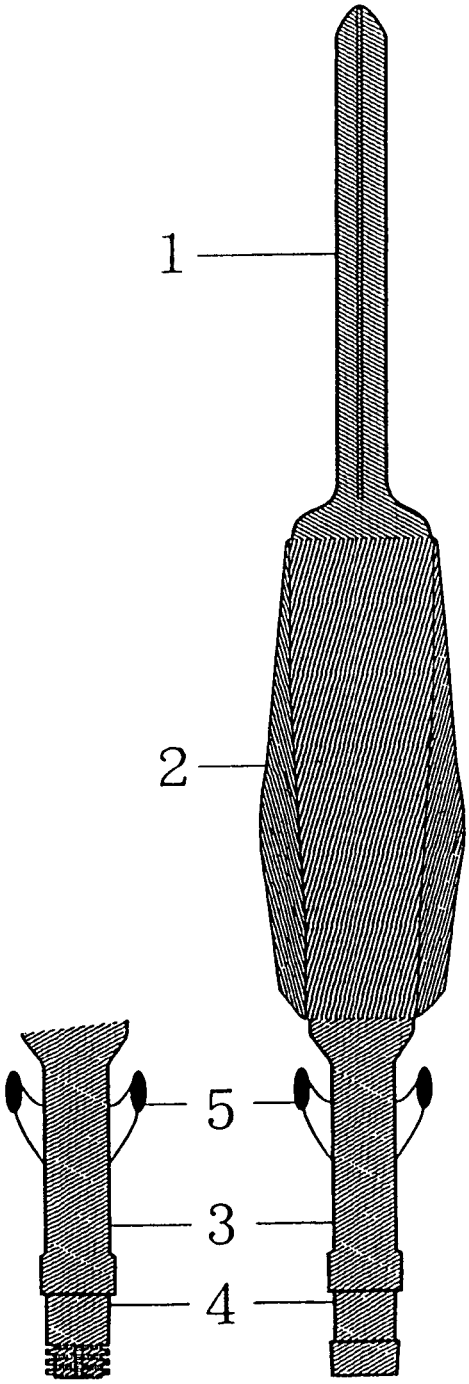
FIG. 3 shows a front planar schematic view illustrating a wedge-type structure according to the invention.
Figure 4:
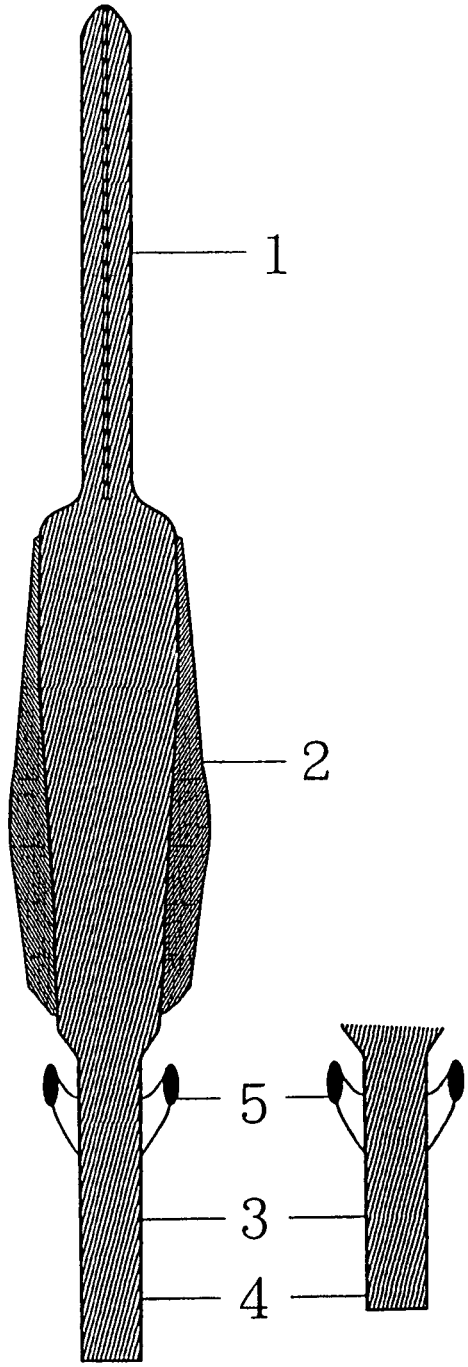
FIG. 4 shows a front planar schematic view illustrating a join-type structure according to the invention.
Figure 5:
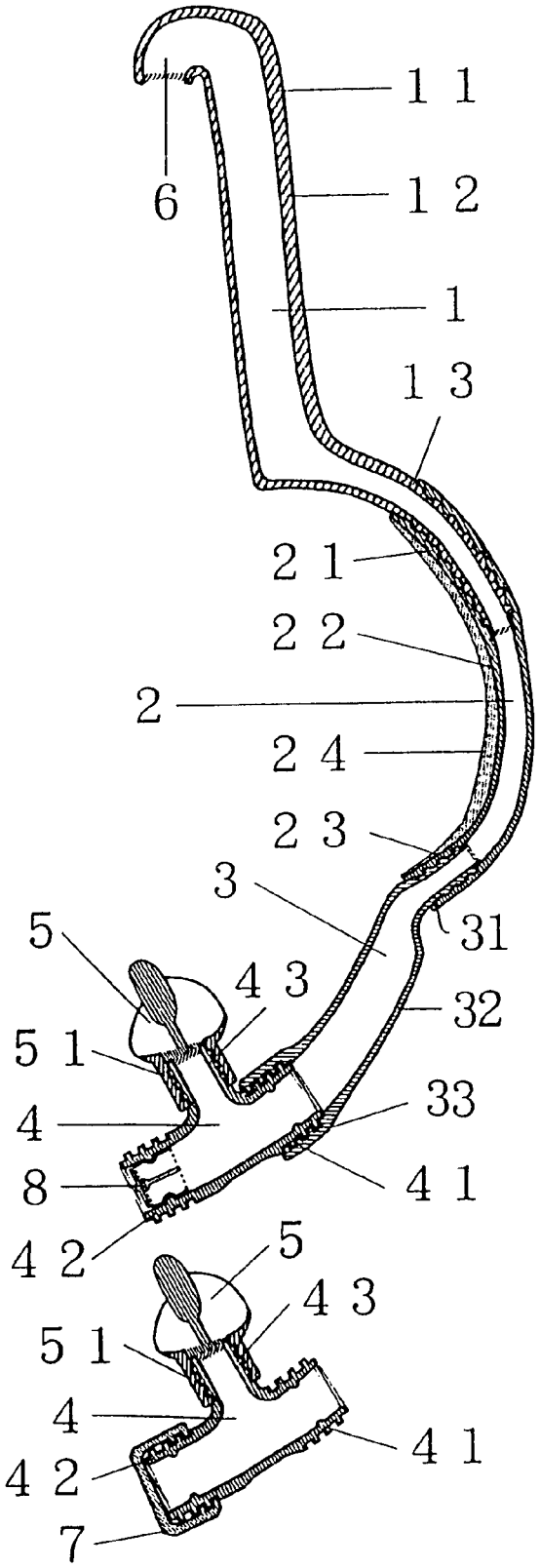
FIG. 5 shows a left side longitudinal sectional schematic view illustrating a wedge-type structure according to the invention.
Figure 6:
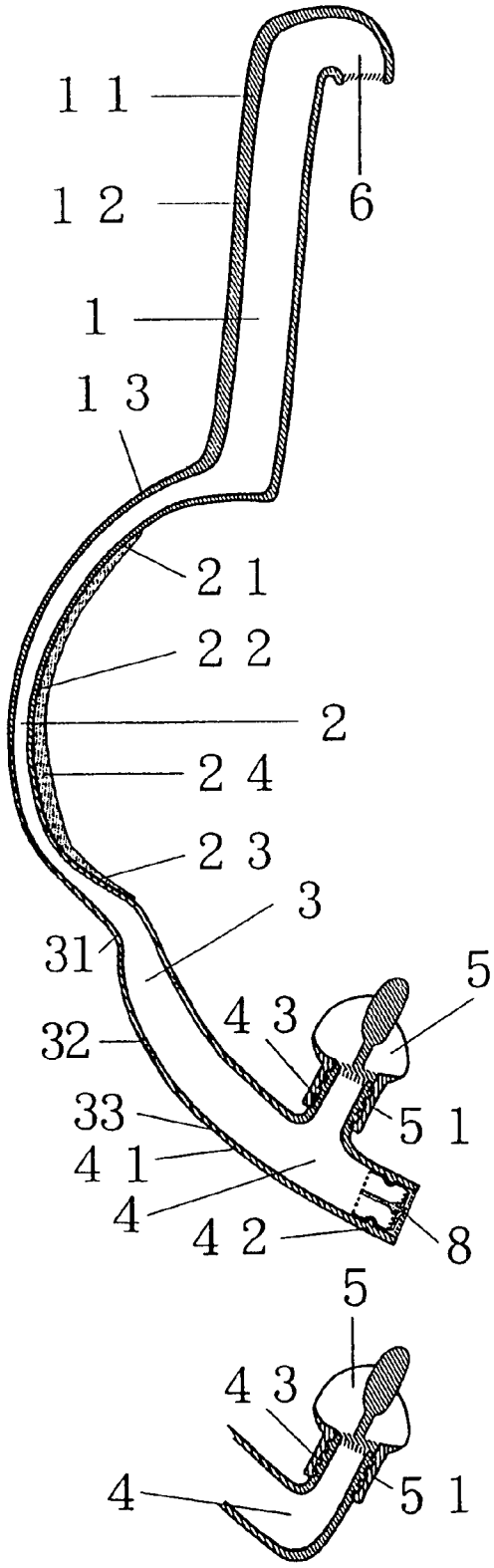
FIG. 6 shows a right side longitudinal sectional schematic view illustrating a join-type structure according to the invention.
Figure 7:
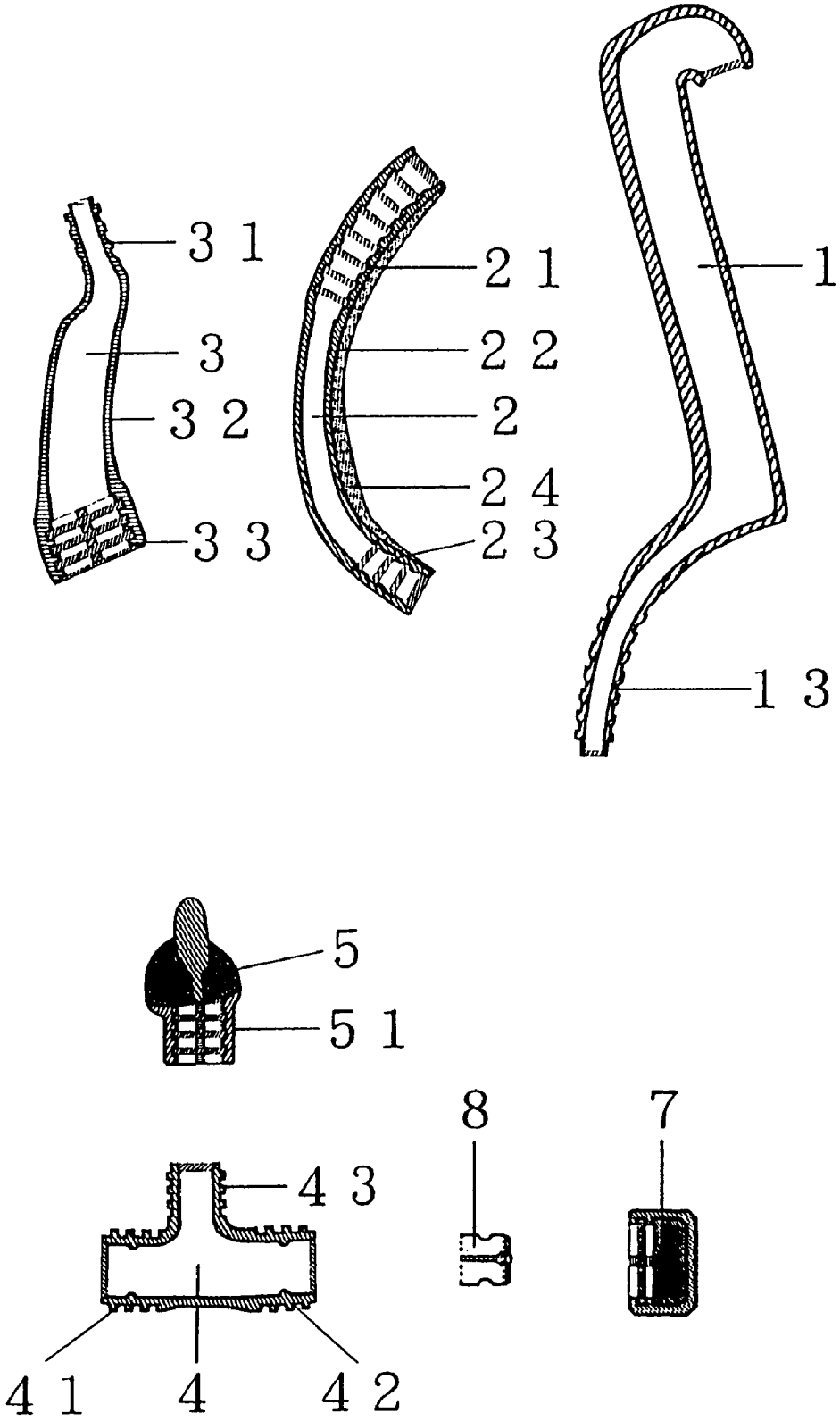
FIG. 7 shows an exploded right side longitudinal sectional schematic view illustrating a wedge-type structure according to the invention.
Figure 8:
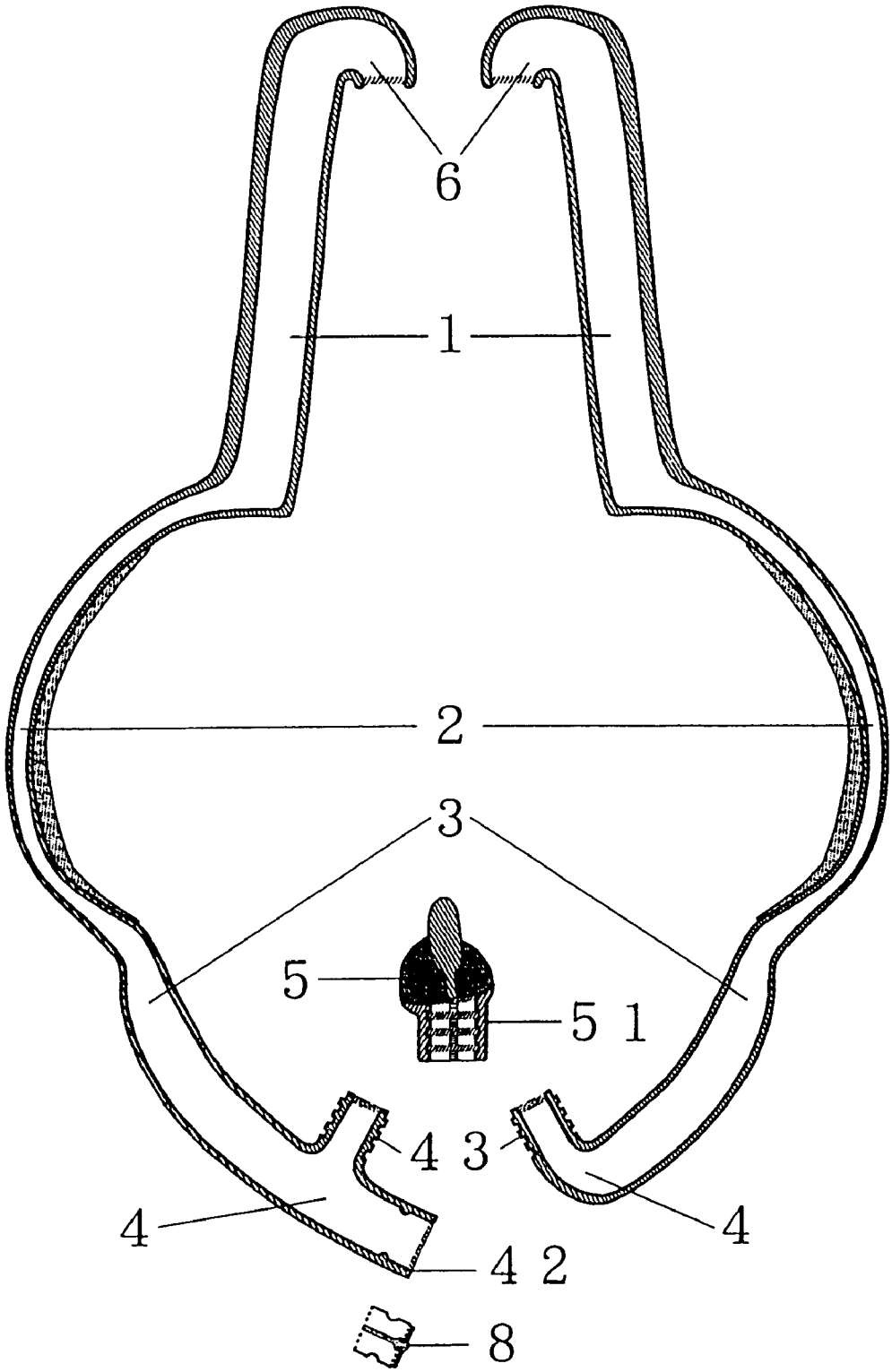
FIG. 8 shows an exploded side longitudinal sectional schematic view illustrating a join-type structure according to the invention.
Figure 9:
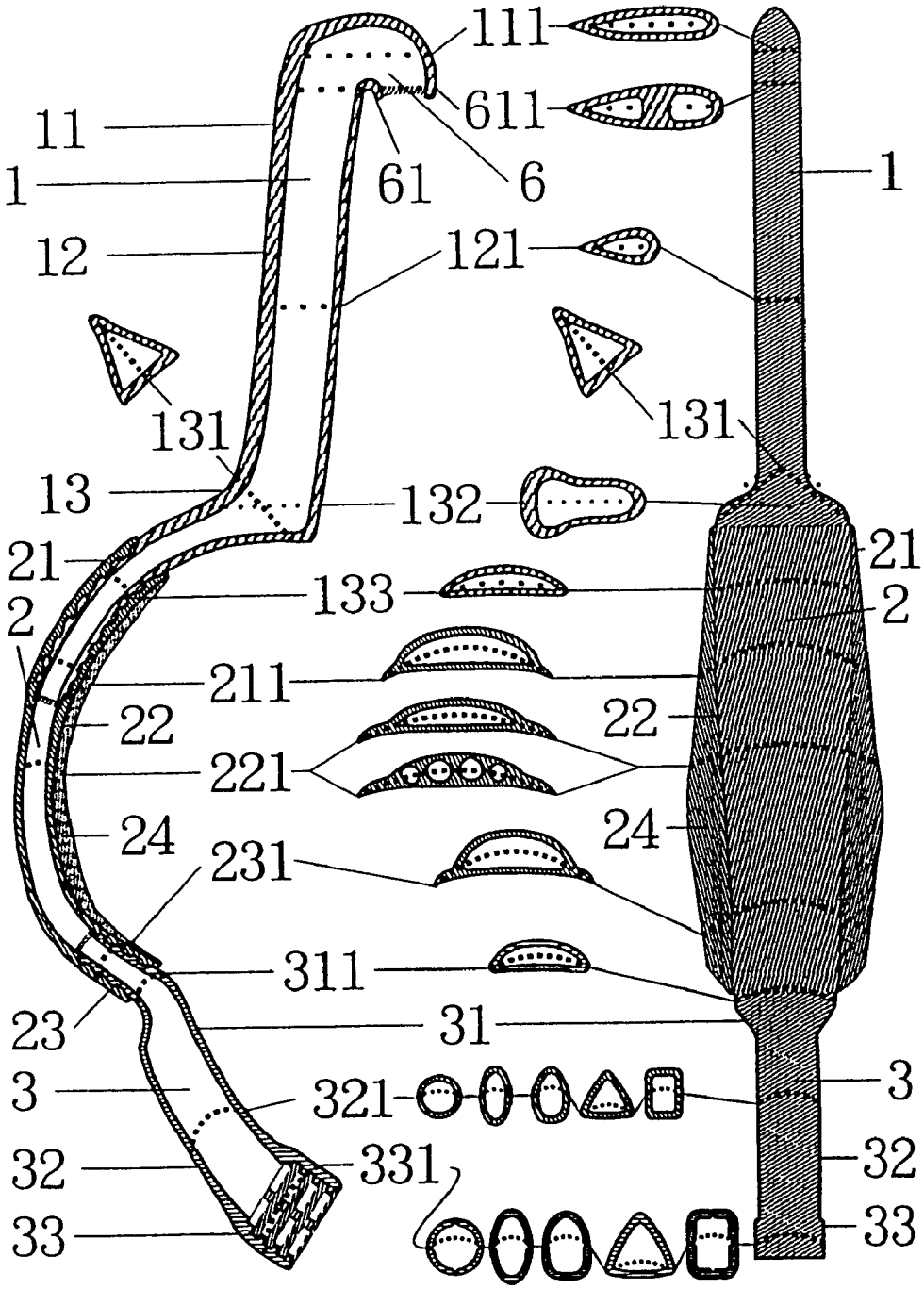
FIG. 9 shows a transverse sectional schematic view illustrating various parts of a wedge-type tube according to the invention.
Figure 10:
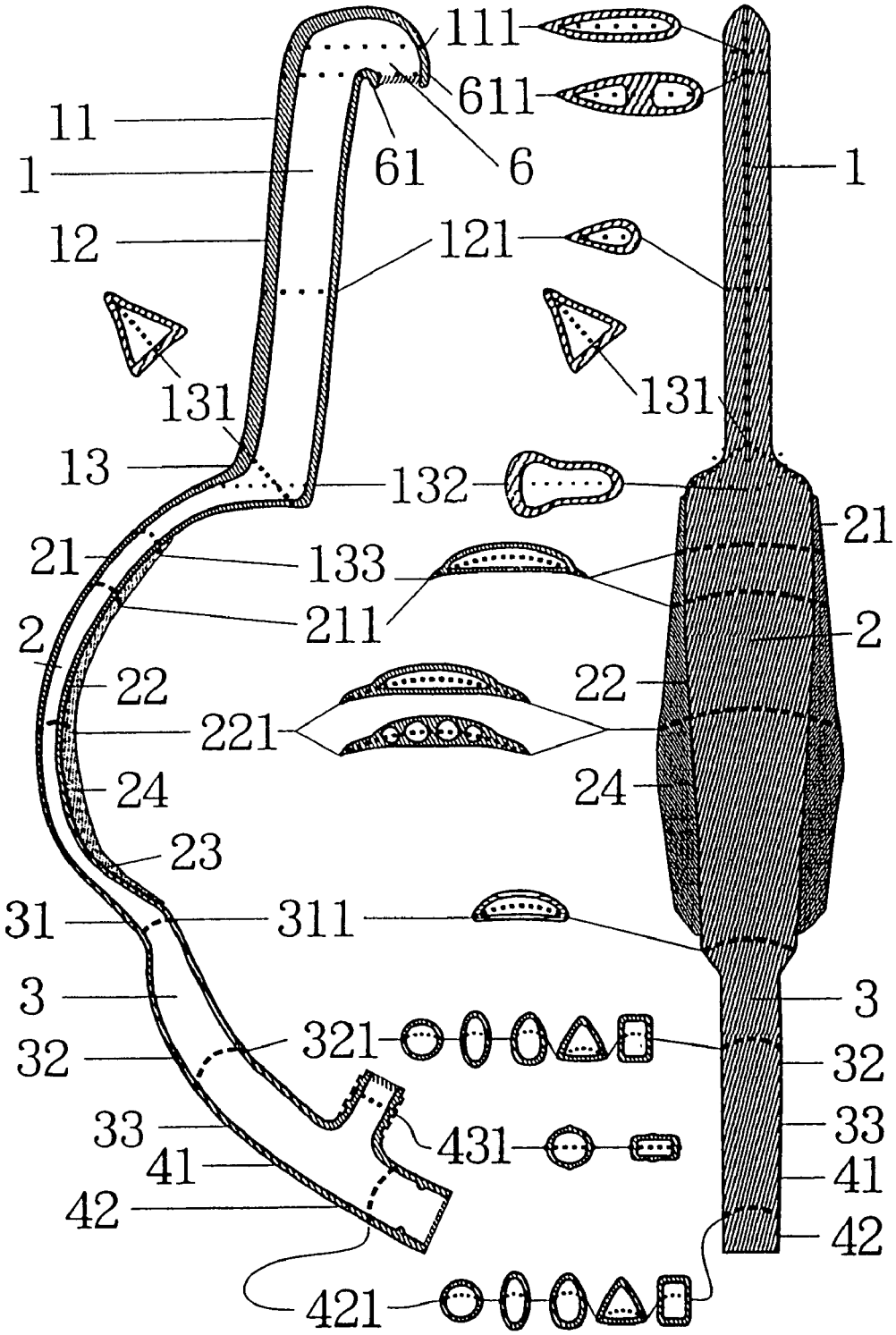
FIG. 10 shows a transverse sectional schematic view illustrating various parts of a join-type tube according to the invention.
Figure 11:
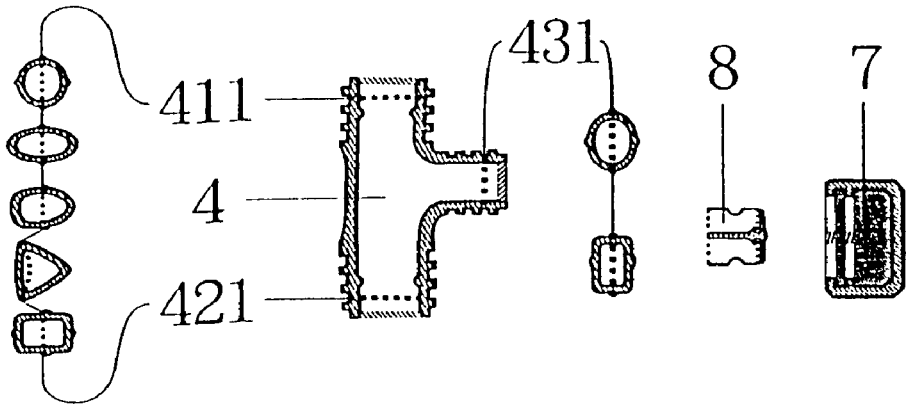
FIG. 11 shows a sectional schematic view illustrating various parts of a mouthpiece according to the invention.
Figure 12:
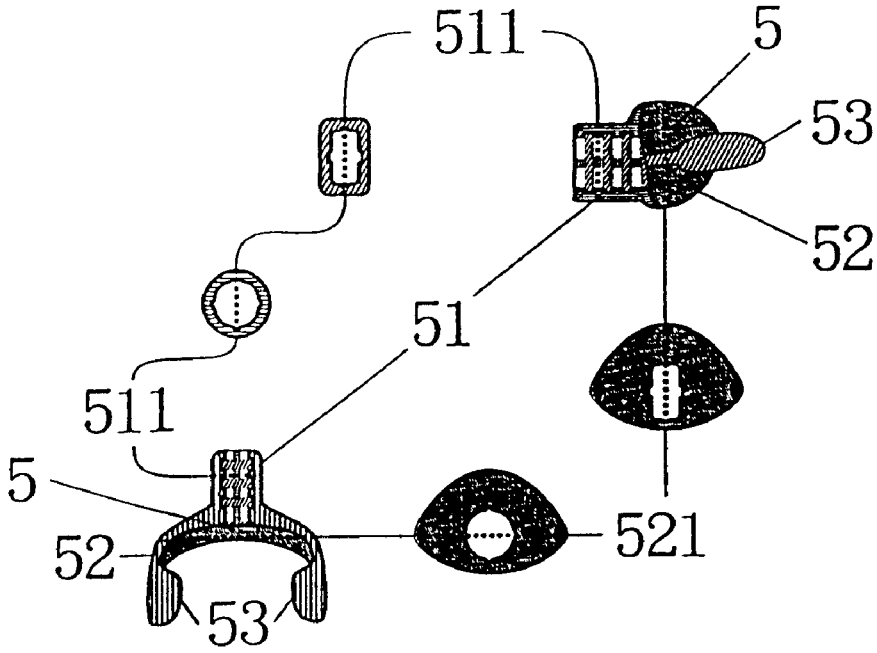
FIG. 12 shows a sectional schematic view illustrating various parts of a fish-mouth-shaped mouthpiece according to the invention.

To better understand characteristics and novelty of the invention, detailed descriptions shall be given with the accompanying drawings below.

Referring to FIGS. 1, 2, 3 and 4 showing an entire structure according to the invention, it is observed that fastening assemblies namely fastening rings, hooks, buttons, clamps, sheaths or strips are not required. Instead, by merely utilizing tubes 1, 2 and 3 in conjunction with a mouthpiece 4 and a fish-mouth-shaped mouthpiece 5, the invention is adapted to steadily stay close to a user's head. During inhalation of the user, air is inhaled in a downward direction via a ventilation opening 6 at an uppermost end. When the invention is in use, water is unlikely allowed to enter the ventilation opening 6 even when the entire respiratory tube is immersed in water. Also, the ventilation opening 6 at the uppermost end enables the user to exhale waste air or accumulated water in the tube during exhalation of the user.

With reference to FIGS. 5, 6, 7 and 8, it is observed from the diagrams that a maximum of four crucial wedge sections with adjustable lengths are utilized, so as to have the structure stay close to a user's head according to left contours of the user's head. The four crucial sections shall be illustrated below.

A head-top-portion tube 1 has a lower wedge 13 for coordinating with an upper wedge groove 21 of a forehead-portion tube 2. A joining depth of the lower wedge 13 and the upper wedge groove 21 is adjustable for coordinating with a longitudinal length of a top of a user's head. Or, a join-type tube suitable for the longitudinal length of the top of the user's head is directly selected, thereby eliminating a set of wedge design.

The forehead-portion tube 2 has a lower wedge groove 23 for coordinating with an upper wedge 31 of the mouth-eyebrow-portion tube 3. A joining depth of the lower wedge groove 23 and the upper wedge 31 is adjustable for coordinating with a longitudinal length of the user's forehead. Or, a join-type tube suitable for the longitudinal length of the user's forehead is directly selected, thereby eliminating a set of wedge design.

The mouth-eyebrow-portion 3 has a lower wedge groove 32 for coordinating with a first wedge 41 of the mouthpiece 4, or a second wedge 42 of the mouthpiece 4 based on a length of eyebrows to a nose tip of the user. A joining depth of the lower wedge groove 32 and the first wedge 41 or the second wedge 42 is adjustable for coordinating with a longitudinal length of the user's face. Or, a join-type tube suitable for the longitudinal length of the user's face is directly selected, thereby eliminating a set of wedge design.

The mouthpiece 4 has a mouth-portion wedge 43 for coordinating with a front wedge groove 51 of the fish-mouth-shaped mouthpiece 5. A joining depth of the mouth-portion wedge 43 and the front wedge groove 51 is adjustable for coordinating with a height of the user's nose bridge.

Apart from transverse channels, the lower wedge groove 32 of the mouth-eyebrow-portion tube 3, the first wedge 41 or the second wedge 42 of the mouthpiece 4, the mouth-portion wedge 43 of the mouthpiece 4, and the front wedge groove 51 of the fish-mouth-shaped mouthpiece 5, are all provided with longitudinal channels, such that these parts are prevented from rotating and deviating when assembled by wedging.

Using the aforesaid four wedge sets maximum, the invention is capable of steadily staying close to a user's head.

Referring to FIGS. 9, 10, 11 and 12 showing sectional view of various parts of the three tubes 1, 2 and 3, the mouthpiece 4 and the fish-mouth-shaped mouthpiece 5, characteristics of the invention shall be described.

A transverse sectional area 111 at an upper end 11 of the head-top portion tube 1 and a transverse sectional area 611 of the ventilation opening 6 are long and narrow hollow water-drop-shaped designs, and a transverse sectional area 121 of a middle sectional area 12 is similarly a long and narrow hollow water-drop-shaped design, so as to altogether minimize water drag force and to guide turbulent flows to further prevent the head-top-portion tube 1 from shaking. Transverse sections 131, 132 and 133 at a lower end 13 gradually form wide and flat hollow structures, which are for adapting to the top of the user's head and to wedge or join with a wide and flat upper end 21 of the forehead-portion tube 2.

A transverse sectional area 211 at the upper end 21, a transverse sectional area 221 of a middle sectional area 22 and a transverse sectional area 231 of a lower end 23 of the forehead-portion tube 2 are wide and flat hollow structures, wherein the transverse sectional area 221 is a single-cavity or multiple-cavity design. The forehead-portion 2 is further provided with a flat and bent wing portion 24 at two sides thereof, respectively, so as to maintain the tube to stay closely to the user's head. As a swimmer's speed gets faster and water drag force received relatively gets larger, without increasing an original sectional area of the user's head and causing displacement and disengagement of the respiratory tube, force for pressing the forehead-portion tube 2 tightly against the user's head is formed, thereby more steadily maintaining the respiratory tube at the user's head.

A transverse sectional area 311 at an upper end 31 of the mouth-eyebrow-portion tube 3 is a wide and flat hollow structure for wedging or joining with the wide and flat lower end 23 of the forehead-portion tube 2. A transverse sectional area 321 of a tube 32 and a transverse sectional area 331 of a tube 33 are hollow structures being round, ellipsoidal, and oval in shaped, or hollow triangular and rectangular designs having a round pointed end. The lower end 33 is wedged or joined with the first end 41 or the second end 42 of the mouthpiece 4 in front of the user's nose tip.

A transverse sectional area 411 at the first end 41 and a transverse sectional area 421 at the second end 42 of the mouthpiece 4 are both round, ellipsoidal or oval in shaped, or hollow triangular and rectangular designs having a round pointed end. Either one of the first end 41 or the second end 42 is wedged or joined with the lower end 33 of the mouth-eyebrow-portion tube 3, while the other is sealed with a sealing cover 7 or installed with a one-direction valve 8 for discharging water and air in a downward direction. A transverse sectional area 431 at the mouth-portion end 43 is a round hollow structure or a rectangular hollow structure having a round pointed end, so as to wedge or join with a neck portion 51 of the fish-mouth-shaped mouthpiece 5.

A transverse sectional area 511 at the neck portion 51 of the fish-mouth-shaped mouthpiece 5 is a round hollow structure or a rectangular hollow structure having a round pointed end. A transverse sectional area 521 at a mouthpiece portion 52 is an open fish-mouth shape that coincides with the user's mouth when the user's mouth is opened in a natural manner, thereby containing the mouthpiece portion 52 in the user's mouth. To adapt to the user's upper and lower front and rear molar teeth and permanent teeth, a bite-piece 53 is provided as a widened, deepened and thickened structure. Hence, users undergoing tooth change-over phase are prevented from usage complications. Also, magnitudes of biting force are easily controlled without leading to mouth muscular pains, and lower lips of users can be stretched to a wider extent while leaving breathing of the user unobstructed.

From the aforesaid descriptions, it is apparent that coherence is present between designs of all the parts. A maximum of four wedge sets up is provided in wide and flat structures being round, ellipsoidal and oval in shape, or triangular and rectangular shapes having a round pointed end. The wedge grooves are disposed with not only transverse channels but also longitudinal channels, such that the respiratory tube is not deviated and slanted when assembled. Furthermore, regardless of degree of design variations in transverse sections of various parts of the respiratory tube, sufficient sectional area is reserved for ventilation in all the tubes of the respiratory tube in order to maintain smooth breathing of the user.

Figure 13:
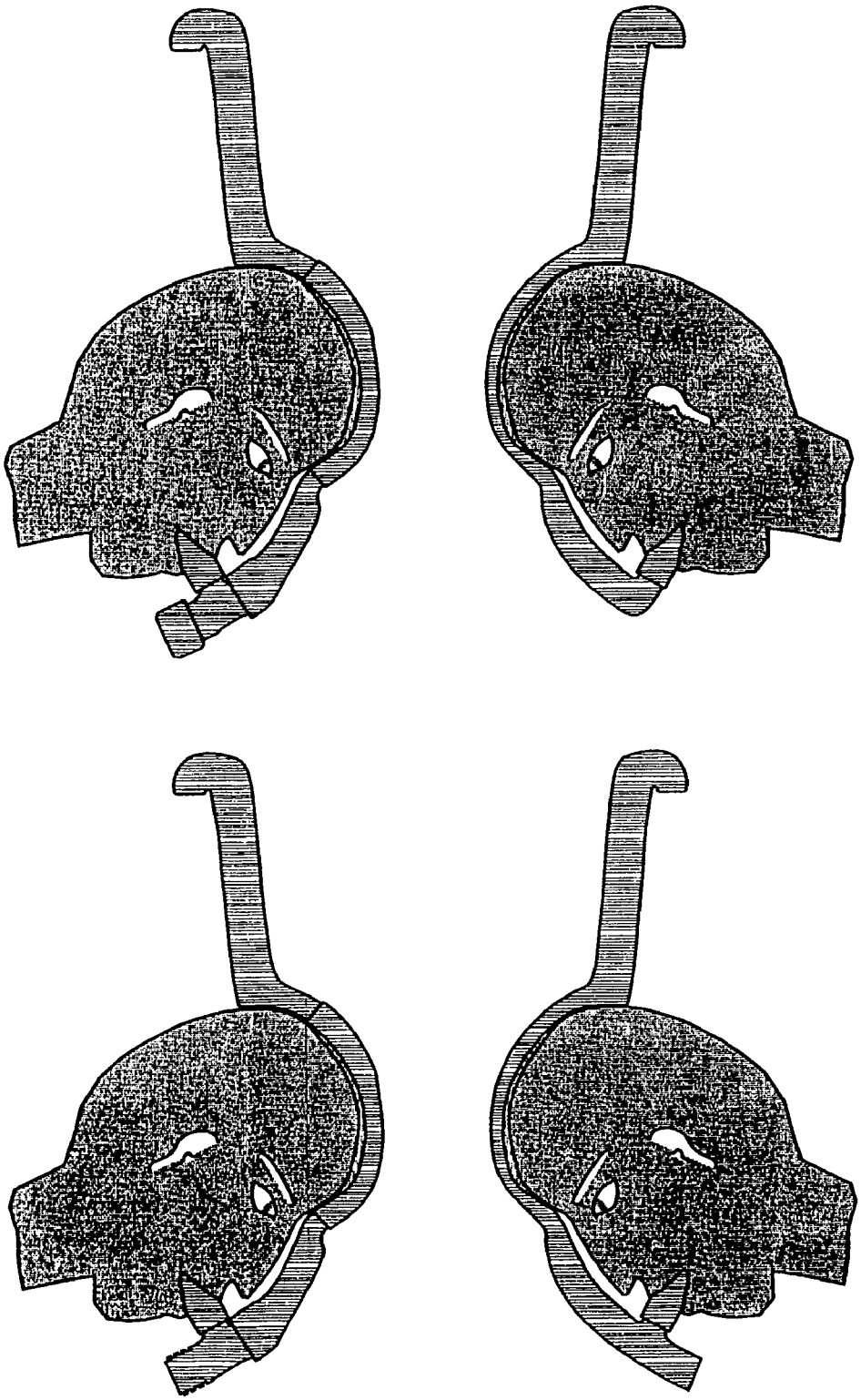
FIG. 13 shows a sectional schematic view illustrating the invention in use.
Figure 14:
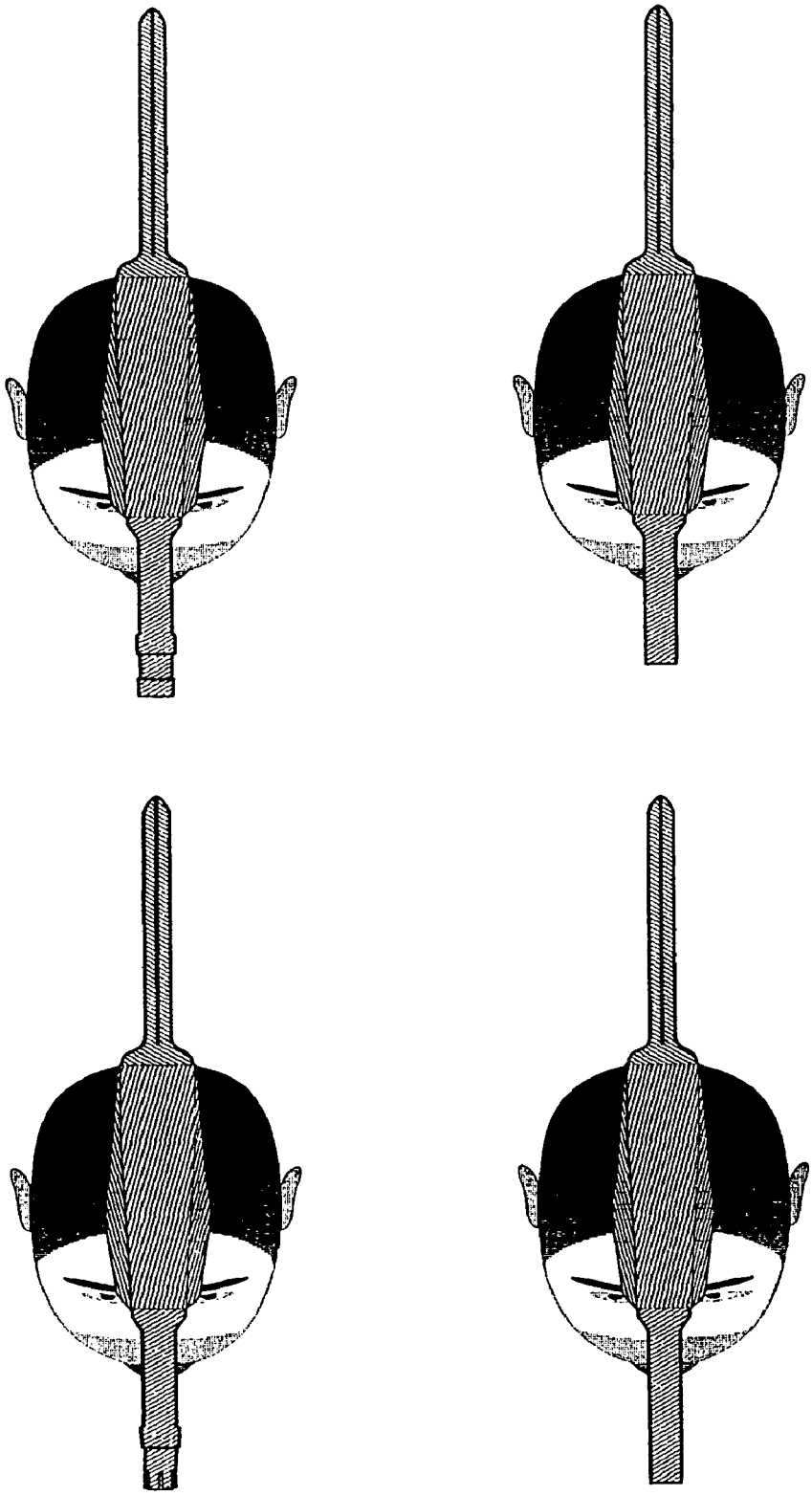
FIG. 14 shows a front schematic view illustrating the invention in use.

Referring to FIGS. 13 and 14 showing a side view and a front view illustrating the invention in use, the invention is a structure capable of staying closely to the user's head when being worn merely by using designs of various parts thereof.

Conclusive from the above, the respiratory tube according to the invention is free from any fastening rings, hooks, buttons, clamps, sheaths or strips as in prior inventions, and is capable of steadily staying close to a user's head when in use. The invention is indeed a practical tool when applied by either beginners or professional athletes in water activities. It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A front-worn respiratory tube without fastening assemblies namely fastening rings, hooks, buttons, clamps, sheaths or strips, comprising a head-top-portion tube, a forehead-portion tube, a mouth-eyebrow-portion tube, a mouthpiece and a fish-mouth-shaped mouthpiece in a downward direction in sequence; wherein, the aforesaid five parts are either wedge-type structures or join-type structures at three sections from the head-top-portion tube to the forehead-portion tube, from the forehead-portion tube to the mouth-eyebrow-portion tube, and from the mouth-eyebrow-portion tube to the mouthpiece portion, and a maximum of four wedge sets having adjustable lengths are utilized for adapting to head dimensions and a height of a noise bridge of a user.

2. The front-worn respiratory tube without fastening assemblies namely fastening rings, hooks, buttons, clamps, sheaths or strips in accordance with claim 1, wherein a water-drop-shaped transverse sectional area at the head-top-portion tube and a ventilation opening at an uppermost end thereof are for inhaling fresh air and exhaling waste air, discharging accumulated water in the tube, and preventing water from entering the tube when the respiratory tube is totally immersed in water; and a deformed wide and flat hollow structure near the head-top-portion is for joining or wedging with an upper end of the forehead-portion tube, thereby maintaining unhindered ventilation.

3. The front-worn respiratory tube without fastening assemblies namely fastening rings, hooks, buttons, clamps, sheaths or strips in accordance with claim 1, wherein a wide and hollow bent hollow structure having single cavity or multiple cavities at the forehead-portion, in conjunction with flat wing portions at two sides of the tube, are steadily stayed closely to a user's head, with the tube staying even more steadily closely as water drag force gets larger when a swimming speed of a swimmer gets faster.

4. The front-worn respiratory tube without fastening assemblies namely fastening rings, hooks, buttons, clamps, sheaths or strips in accordance with claim 1, wherein a transverse sectional area at an upper end of the mouth-eyebrow-portion tube is a wide and flat hollow structure suitable for joining or wedging with a lower end of the forehead-portion tube to further maintain unhindered ventilation; a transverse sectional area at a lower end of the mouth-eyebrow-portion tube is transformed into a round, ellipsoidal or oval hollow structure, or a triangular or rectangular hollow design having a round pointed end; and the lower end of the mouth-eyebrow-portion tube is for wedging or joining with a shorter first end or a longer second end of the mouthpiece.

5. The front-worn respiratory tube without fastening assemblies namely fastening rings, hooks, buttons, clamps, sheaths or strips in accordance with claim 1, wherein a transverse sectional area of the first end or the second end of the mouthpiece is round, ellipsoidal or oval in shape, or triangular or rectangular design having a round pointed end; one end of the mouthpiece is joined or wedged with the lower end of the mouth-eyebrow-portion tube, and the other end thereof is sealed or installed with a one-direction valve serving as an exit for discharging water and air in a downward direction; and a mouth-portion end thereof is round in shape or a rectangular structure having a round pointed end, and is joined or wedged with the fish-mouth-shaped mouthpiece.

6. The front-worn respiratory tube without fastening assemblies namely fastening rings, hooks, buttons, clamps, sheaths or strips in accordance with claim 1, wherein the fish-mouth-shaped mouthpiece is a widened, deepened and thickened bite-piece for adapting to upper-row and lower-row front and rear molar teeth, and permanent teeth of grown-ups; magnitudes of biting force are easily controlled without leading to mouth muscular pains, and lower lips of users can be stretched to a wider extent while leaving breathing of the user unobstructed; the fish-mouth-shaped mouthpiece conforms to a mouth shape when the mouth is opened naturally while doing stretching or light exercises; and a neck of the fish-mouth-shaped mouthpiece is round in shape or a rectangular structure having a round pointed end as well as a long vertical length and a short horizontal length.

* * * * *